US007011470B1

(12) United States Patent
Breazeale et al.

(10) Patent No.: US 7,011,470 B1
(45) Date of Patent: Mar. 14, 2006

(54) RETRACTABLE SPEED BUMP

(76) Inventors: Orville Alan Breazeale, 8307 CR 6920, Lubbock, TX (US) 79407; Gregory Mark Lee, 5416 80th, Lubbock, TX (US) 79424; Charles J. Cole, 1095 Rolling Park La., Fort Mill, SC (US) 29715

( * ) Notice: Subject to any disclaimer, the term of this patent is extended or adjusted under 35 U.S.C. 154(b) by 0 days.

(21) Appl. No.: 10/810,861

(22) Filed: Mar. 29, 2004

(51) Int. Cl.
*E01F 9/07* (2006.01)

(52) U.S. Cl. ..... 404/11; 404/9; 404/10; 404/15

(58) Field of Classification Search ..... 404/6, 404/9, 10, 11, 12, 14, 15
See application file for complete search history.

(56) References Cited

U.S. PATENT DOCUMENTS 4,097,170 A * 6/1978 Dickinson ..... 404/6
4,373,464 A * 2/1983 Blau ..... 116/63 R
4,576,508 A * 3/1986 Dickinson ..... 404/6
4,666,331 A * 5/1987 Riley ..... 404/6
4,737,049 A * 4/1988 Callhan ..... 359/551
5,074,706 A * 12/1991 Paulos ..... 404/12
5,192,159 A * 3/1993 Higginson ..... 404/11
5,267,808 A * 12/1993 Welford ..... 404/11
5,397,197 A * 3/1995 Beavers ..... 404/10
5,904,443 A * 5/1999 Soleau ..... 404/6
6,010,277 A * 1/2000 Follman ..... 404/11
6,099,200 A * 8/2000 Pepe et al. ..... 404/6
2005/0031411 A1 * 2/2005 Hensley ..... 404/11

* cited by examiner

*Primary Examiner*—Raymond W Addie
(74) *Attorney, Agent, or Firm*—Peter Loffler

(57) ABSTRACT

A retractable speed bump helps control the speed of a vehicle traveling through a special speed zone such as a school zone or a road construction site. A housing is either buried in the roadway or is placed into a ramp that seats on top of the roadway, the housing having a retractable canister therein, which canister extends above the housing in response to the speed of a vehicle as detected by a speed sensor. The greater the speed of the vehicle, the greater the level of extension of the canister. The canister may have tire shredding spikes or explosive charges therein.

23 Claims, 4 Drawing Sheets

RETRACTABLE SPEED BUMP

BACKGROUND OF THE INVENTION

1. Field of the Invention

The present invention relates to a speed bump that is retractable based on the driving parameters of an approaching car, which speed bump can be either fixed at a location or can be portable.

2. Background of the Prior Art

Speeding is a problem on most roads and highways. Today's vehicles are powerful and reliable and are very stable and quiet even at very high speeds. Accordingly, many drivers push their vehicles and go well beyond the speed that is appropriate for the setting within which the vehicle is operating.

One area where speeding vehicles are of particular concern is the special traffic zone such as a school zone or a road construction site. In a school zone, a large number of students are released in a small time frame, flooding the area with these students. The students chase each other, engage in horseplay, or otherwise act as kids and oftentimes dart out into the road without looking to see if traffic is approaching. This is especially true for the younger children at middle and elementary schools. A speeding driver can easily hit a student who, due to being young and inexperienced makes a mistake, or who trips and falls or is pushed by another student and lands on the roadway. A small childhood mistake can lead to very serious consequences.

At a road construction site, workers tend to be in very close proximity to traffic that can zip by at 30 mph, 40 mph, or even elevated highway speeds. One small distraction (talking on the phone, fumbling with the radio, etc.), or other mistake by a driver can lead to serious injury or death of a number of the construction site works.

In order to address such problems and protect pedestrians at special zones, most states have traffic rules for special zones, which traffic rules not only lower the speed through a school zone or a road construction zone, but also raise the fine and points against the driver's license that are associated with a speeding violation within such a zone. Oftentimes, such fines are double or more for a similar infraction that occurs outside of a special zone. While many officers tend to give drivers a small leeway in speeding enforcement, for example, an officer may not ticket a driver on an interstate highway if the driver is within 5 mph of the speed limit, most officers have no tolerance for any amount of speeding within a school zone or a road construction zone. Many localities post an officer at a school zone at the start of a school day and at the end of the school day, both to act as a deterrence as well as to pull over and ticket speeders. Likewise, many construction sites also have one or more officers present, especially on highway construction sites. In fact, many states mandate that the contractor of a highway construction site hire highway patrol officers to help reduce speed at such sites.

These measure help reduce the vehicle speeds through these zones and thus make such zones safer for the students and construction workers. However, there are only a finite number of officers available at any given time, especially on a highway construction site that may extend for many miles. Additionally each officer can only witness and stop so much traffic, and if an officer is ticketing a law breaker, that officer is effectively taken of action from the zone until that officer finishes with the current speeder. Accordingly, despite law enforcement efforts, vehicles continue to speed through these special zones.

Therefore, there exists a need in the art for a device that helps control the speed of vehicles through a special speed zone such as a school zone or a road construction site. Such a device needs to be able to automatically perform its function in order to complement the finite availability of law enforcement officers. Such a speed control device must be of relatively simple construction and operation and must provide a sufficient level of deterrence to the would be speeder. As increased speed of a vehicle through a special zone correlates with increased danger, the device should be able to increase its level of deterrence to higher speed vehicles.

SUMMARY OF THE INVENTION

The retractable speed bump of the present invention addresses the aforementioned needs in the art. The retractable speed bumps helps reduce the speed of vehicles through a special zone such as a road construction site or a school zone in order to increase safety to workers and students respectively. The retractable speed bump is an automatic device that helps complement the work performed by law enforcement officers, which officers are necessarily finite in number and availability at a given special speed zone. The retractable speed bump is of relatively simple and straightforward design and construction and is relatively easy to implement. The present invention provides an increasing level of deterrence to a speeding driver based on a particular vehicle's increased speed through a zone.

The retractable speed bump of the present invention is comprised of a housing that has a top with an opening, a bottom, and a hollow interior. A plate having an upper surface and a lower surface, is slidably disposed within the interior of the housing. A bump canister is disposed within the interior of the housing and is capable of protruding through the opening. A pressure source is connected to the housing and is capable of placing pressure, either hydraulic or pneumatic, on the lower surface of the plate such that when the pressure source places pressure onto the plate, the plate slides upwardly toward the top of the housing causing the bump canister to protrude through the opening and when the pressure source is not placing pressure onto the plate, the plate slides downwardly toward the bottom of the housing causing the bump canister to retract back into the housing. The pressure source is activated by a speed sensor that detects the speed of the vehicle such that the pressure source places pressure on the plate whenever the speed sensor detects a vehicle traveling above a defined speed. The amount of pressure exerted by the pressure source is proportional to the amount of speed above the defined speed that the vehicle is traveling as detected by the speed sensor. The speed sensor may be a sensor loop that is buried within the path of travel of the vehicle or a radar gun or any other appropriate speed sensing device. The bump canister may have at least one tubular member that has an angled and sharp top end that is capable of puncturing a tire of the vehicle as the vehicle passes over the bump canister that is protruding through the opening of the housing. Additionally, the bump canister may have a shaped explosive charge held therein. The housing may buried within a roadway wherein the top of the housing is either flush with the roadway or the top of the housing is disposed above the roadway. The top surface of the canister may be rounded. A spring is disposed within the interior of the housing and has a first end abutting the top of the housing and a second end abutting the upper surface of the plate such that the spring biases the plate back toward the bottom of the housing whenever the pressure source reduces or eliminates pressure placed on the plate.

The housing may also be disposed within a ramp member, the ramp member capable of being removably seated onto an existing roadway.

BRIEF DESCRIPTION OF THE DRAWINGS

Similar reference numerals refer to similar parts throughout the several views of the drawings.

DESCRIPTION OF THE PREFERRED EMBODIMENT

Figure 1:
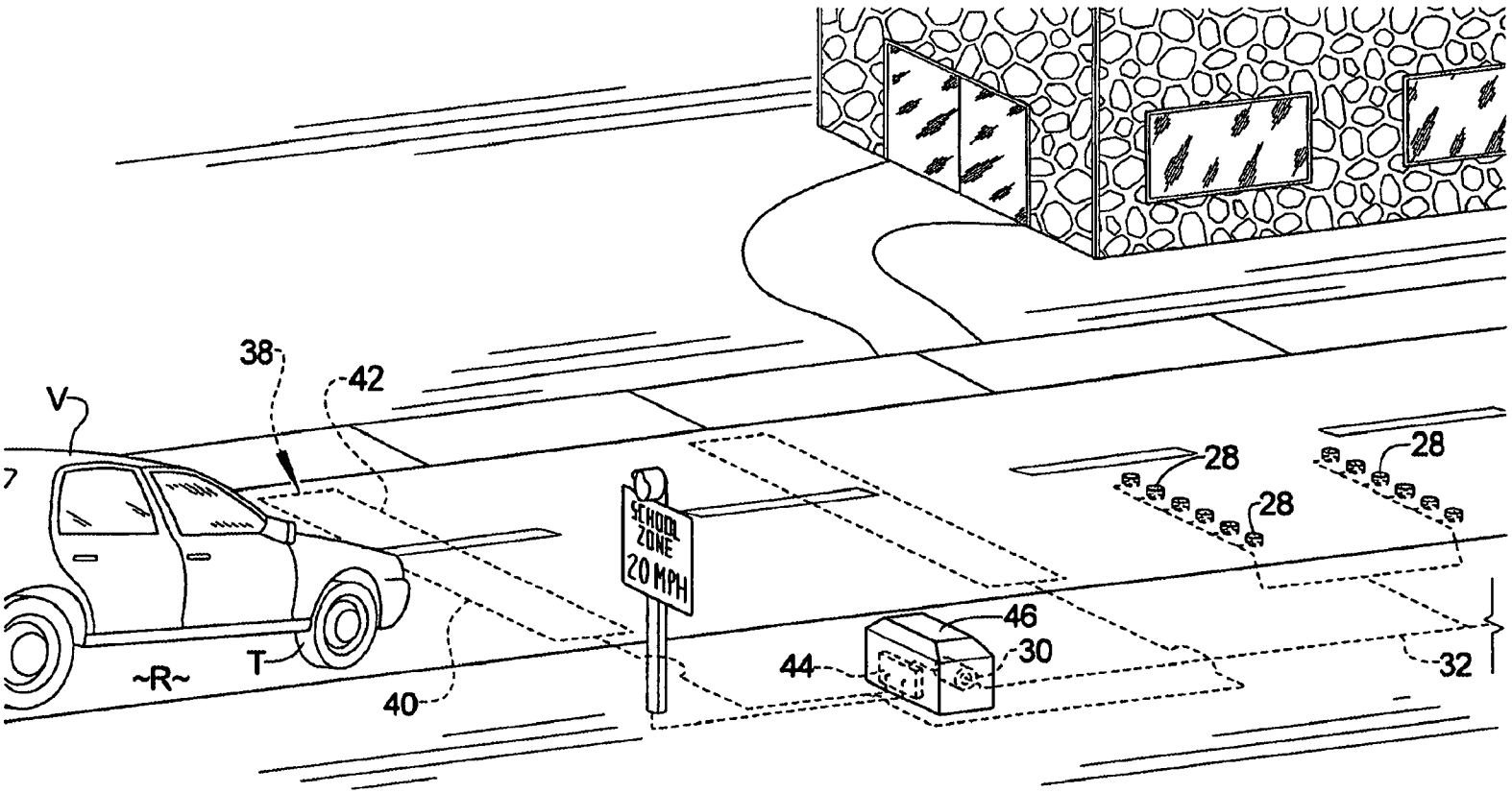
FIG. 1 is an environmental view of the retractable speed bump installed within a school zone.

Referring now to the drawings, it is seen that the retractable speed bump of the present invention, generally denoted by reference numeral 10, is comprised of a housing 12 having a top 14 with an opening, a bottom 16, and a hollow interior 18. A plate 20 has an upper surface 22 and a lower surface 24 and is slidably disposed within the hollow interior 18 of the housing 12. A spring 26 is disposed within the hollow interior 18 of the housing 12 and has an end that abuts against the top 14 of the housing 12 and an opposing end that abuts against the upper surface 22 of the plate 20. A bump canister 28 is disposed within the hollow interior 18 of the housing 12 and seats on the upper surface 22 of the plate 20. The housing 12 is fluid flow connected to a pressure source, such as the illustrated canister 30, via an appropriate hose 32 and a nozzle fitting 34 that connects the hose 32 with the housing 12, the nozzle fitting 34 entering the housing 12 below the plate 20. The pressure source 30 may be pneumatic or hydraulic. When the pressure source 30 is activated, pressure is introduced into the housing 12 and as the nozzle fitting 34 is below the plate 20, pressure is exerted on the lower surface 24 of the plate 20 causing the plate 20 to slide toward the top 14 of the housing 12. This causes the bump canister 28 seated on the upper surface 22 of the plate 20 to rise up with the rising plate 20 and to protrude through the open top 14 of the housing 12 into an extended position. When the pressure exerted on the plate 20 by the pressure source 30 is reduced or eliminated, the spring 26 biases the plate 20 back toward the bottom 16 of the housing 12, which causes the bump canister 28 to retract back into the housing 12 into a retracted position. A stop 36 within the housing 12 limits the amount of downward travel by the plate 20.

In order to use the retractable speed bump 10 of the present invention, the housing 12 is buried within the ground G at a desired location such as the school zone illustrated in FIG. 1. A plurality of housings 12 are buried in a row within the lane of travel of the roadway R and multiple rows of housings 12 can be installed. Each housing 12 is fluid flow connected to the pressure source 30. If necessary, multiple pressure source devices 30 can be used. A speed sensor is provided. The speed sensor can be the sensor loop 38 illustrated in FIG. 1, which sensor loop 38 has a leading edge sensor 40 and a trailing edge sensor 42 such that the leading edge sensor 40 and the trailing edge sensor 42 each sense either pressure thereon as is caused by a tire T of a vehicle V passing over the respective sensor, or each sensor 40 and 42 is magnetic-based such that each sensor magnetically senses the leading edge of the vehicle V passing over the respective sensor 40 or 42. The difference in time between the leading edge sensor 40 sensing the vehicle V and the trailing edge sensor 42 sensing the vehicle V is calculated, and as the distance between the leading edge sensor 40 and the trailing edge sensor 42 is known, the speed of the vehicle V can be calculated. A controller 44 is used to make the calculations. Alternately, the speed sensor can be a typical radar gun (broadly defined to include laser systems, etc.), which can be mounted in an appropriate location. The controller 44 reads the speed of each vehicle V passing along the roadway. If the speed of the vehicle V as sensed by the speed sensor and read by the controller 44 is above a defined speed, such as the speed limit for the zone within which the system 10 is placed, the controller 44 activates the pressure source 30 which introduces pressure into each housing 12 causing the plate 20 within the housing 12 to slide toward the top 14 of the housing 12 causing the bump canister 28 to protrude through the open top 14 of the housing 12 and into the extended position. Each row of housings 12 that have bump canisters 28 in the extended position act as a speed bump in order to persuade the driver of the vehicle V to slow down. When the controller 44 activates the pressure source 30, the amount of pressure developed by the pressure source 30 and exerted into each housing 12 can be constant or the amount of pressure developed by the pressure source 30 and exerted into each housing 12 can be variable based on the amount speed over the defined speed that the vehicle V is traveling as sensed by the speed sensor. This variable pressure development allows greater pressure to be exerted into each housing 12 for vehicles V traveling at greater speeds. As such, the greater the pressure developed by the pressure source 30 and exerted into each housing 12, the further toward the top 14 of the housing 12 that the plate 20 slides and thus the higher the level of extension of the bump canister 28. Therefore, the greater the speed of the vehicle V, the greater the size of the speed bump that is encountered. The pressure source 30 can deactivate after a set amount of time, which may be the time it takes a vehicle V that is initially sensed by the speed sensor to clear the last speed bump created by the device 10 if the vehicle V is traveling at the defined speed. An appropriate bleed valve (not illustrated) may located on the system 10 such as on the pressure source 30 in order to depressurize the system 10 once the pressure source 30 is deactivated in order to allow the spring 26 to bias the plate 20 toward the bottom 16 of the housing 12 and thus to allow the bump canister 28 to return to the retracted position prior to the next vehicle's approach, as the next vehicle may not be speeding and does thus not need to encounter the extended speed bumps. The controller 44 can be programmed to allow the user to define the desired speed above which the system 10 activates in order to place each bump canister 28 into the extended position as well as to determine whether the height of extension of the canister is constant or variable. Additionally, the controller 44 can be programmed in order to activate the system 10 only at certain times of the day, such as at the start and end of the school day and only on certain days, such as school days. Additionally, the controller 44 can be programmed so that at other times (e.g., not at the start and end of the school day and not school days) to make the system 10 continue to be active with a higher defined speed so that vehicles V can travel faster through the zone when it is not a critical time before encountering the speed bumps produced by the system 10. As children tend to congregate at schools at times other than critical times, this feature allows the speed around to be controlled at all times. The controller 44 and the pressure source 30 can be secured within an appropriate housing 46, and if desired, can also be subterraneanally disposed. If the speed sensor is radar based, and the housing 46 is located above ground, the radar gun can be attached to this housing 46. In lieu of using a pressure source 30 system, the raising of the bump canister 28 can be accomplished by the use of magnetics, such as electromagnets that raise the bump canister 28 as desired. Such magnets can be placed along the sides and at the top 14 of the housing 12. In such an embodiment, the spring 26 can continue to be used to return the bump canister 28 to its retracted position, or the magnets of the system 10 can also be used for this purpose.

The pressure source 30 and thus the raising and lowering of the bump canisters 28 can be controlled by device other than the speed sensor, such as a wireless remote control device that sends a control signal to the controller 44 or a control switch held within an appropriate location such as a guard house at the entrance to a sensitive facility such as a military base, an embassy, etc., or such a device may be housed within a police car and the officer can cause the device 10 to be activated, such as if the officer is chasing a fleeing suspect and uses the device 10 to slow or even stop the fleeing vehicle.

Figure 2:
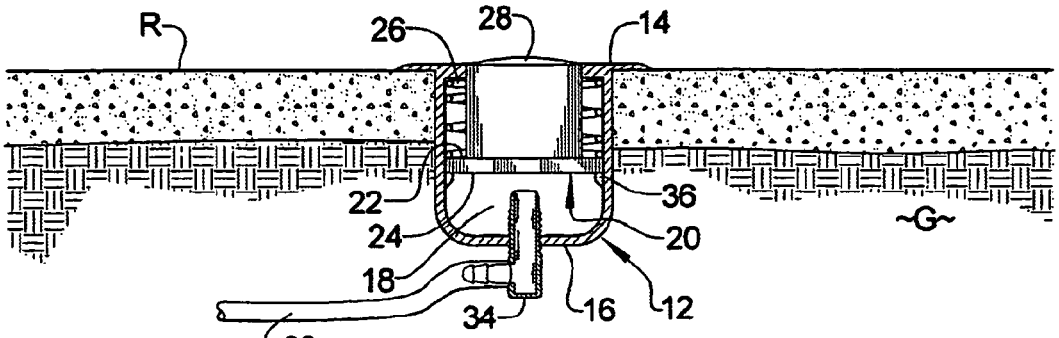
FIG. 2 is a side sectioned view of the retractable speed bump installed in a roadway with the top of the device raised above the surface of the road and with the device in a retracted state.
Figure 3:
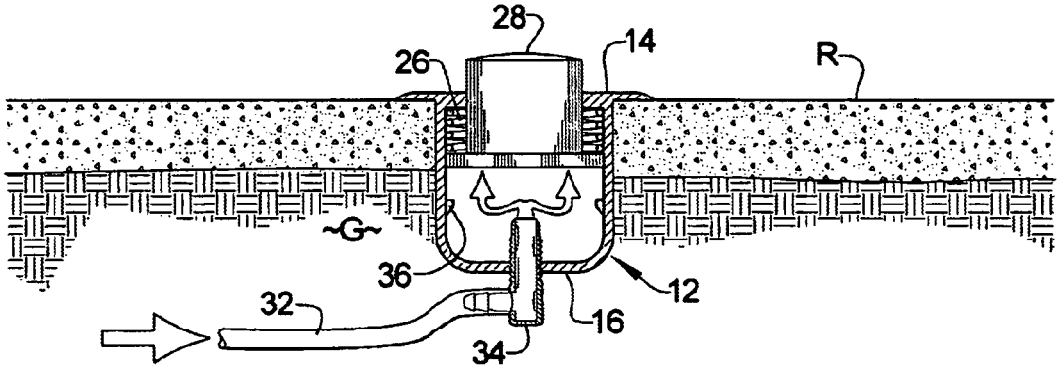
FIG. 3 is a side sectioned view of the retractable speed bump of FIG. 2 with the device in an extended state.
Figure 4:
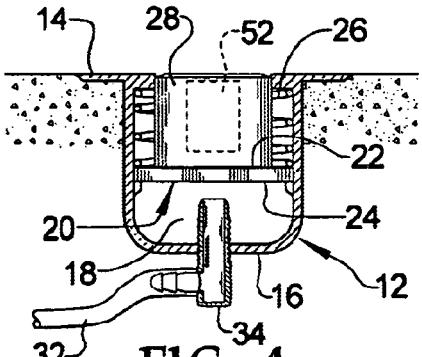
FIG. 4 is a side sectioned view of the retractable speed bump installed in a roadway with the top of the device flush with the surface of the road and with the device in a retracted state.
Figure 5:
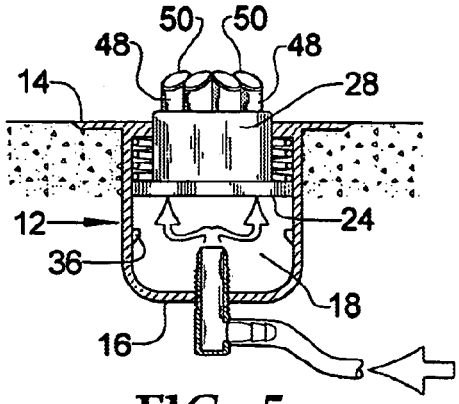
FIG. 5 is a side sectioned view of the retractable speed bump of FIG. 4 with the device in an extended state and with the speed bump having tire shredders.

As seen in FIGS. 2 and 3, the top 14 of the housing can be disposed above the surface of the roadway R with the top of the bump canister 28 being rounded. As such, the housing 12 and the retracted bump canister 28 act as a small speed bump for all vehicles V in order to alert the drivers and slow them down, similar to rumble strips used near many intersections. Alternately, as seen in FIGS. 4 and 5 the top 14 of the housing 12 is generally flush with the roadway R and the top of the bump canister 28 is generally flat. As such, the device 10, in a retracted position, is barely noticed if at all by drivers passing over the system 10. As further seen in FIG. 5, the bump canister 28 has at least one tubular member 48 disposed therein, which tubular member 48 extends out through the top of the bump canister 28 whenever the bump canister 28 is placed into the extended position. Each tubular member 48, which is made from a hard material such as metal, ceramic, etc., has an angled cut top 50, with the outer periphery of the cut top 50 being sharpened so that a vehicle V that passes over the tubular members 48 has its tires T cut by the sharp outer periphery of the cut top 50 of the tubular member 48. This type of a system is best used when speed control is not the primary purpose of the system, rather the disabling of a vehicle V is the primary purpose. Accordingly, the control of a retractable speed bump 10 that uses tire damaging tubular members 48, is typically performed by law enforcement personnel that have a remote control device within the squad car or on their person or guards at a guard house. It the police are chasing a vehicle V that comes toward the retractable speed bump 10, the officers can raise the speed bump and thus the tubular members 48 in order to deflate the tires T of the vehicle, in order to slow and eventually stop the vehicle V, similar to the actions of a stop stick. In a facility protection setting, the first rows of speed bumps may be used to attempt to stop the vehicle, and if unsuccessful, the guards can raise subsequent rows of bump canisters 28, which have the tubular members 48 therein in order to disable the vehicle. If still unsuccessful, still further rows of bump canisters 28 may have shaped explosive charges 52 therein that are detonated as the vehicle passes over these bump canisters 28. In such a multiple class of bump canisters 28, each type of bump canister (regular speed bump, tire damaging, explosive, has either its own pressure source 30 (or the hoses 32 connecting the pressure source 30 with each of the various housings 12 having manifolds that can be controlled) so that the personnel controlling the system 10 can raise and lower only the type of bump canister 28 desired at a given time. Additionally, a separate control switch is used to detonate the explosives 52 used within a bump canister 28.

Figure 6:
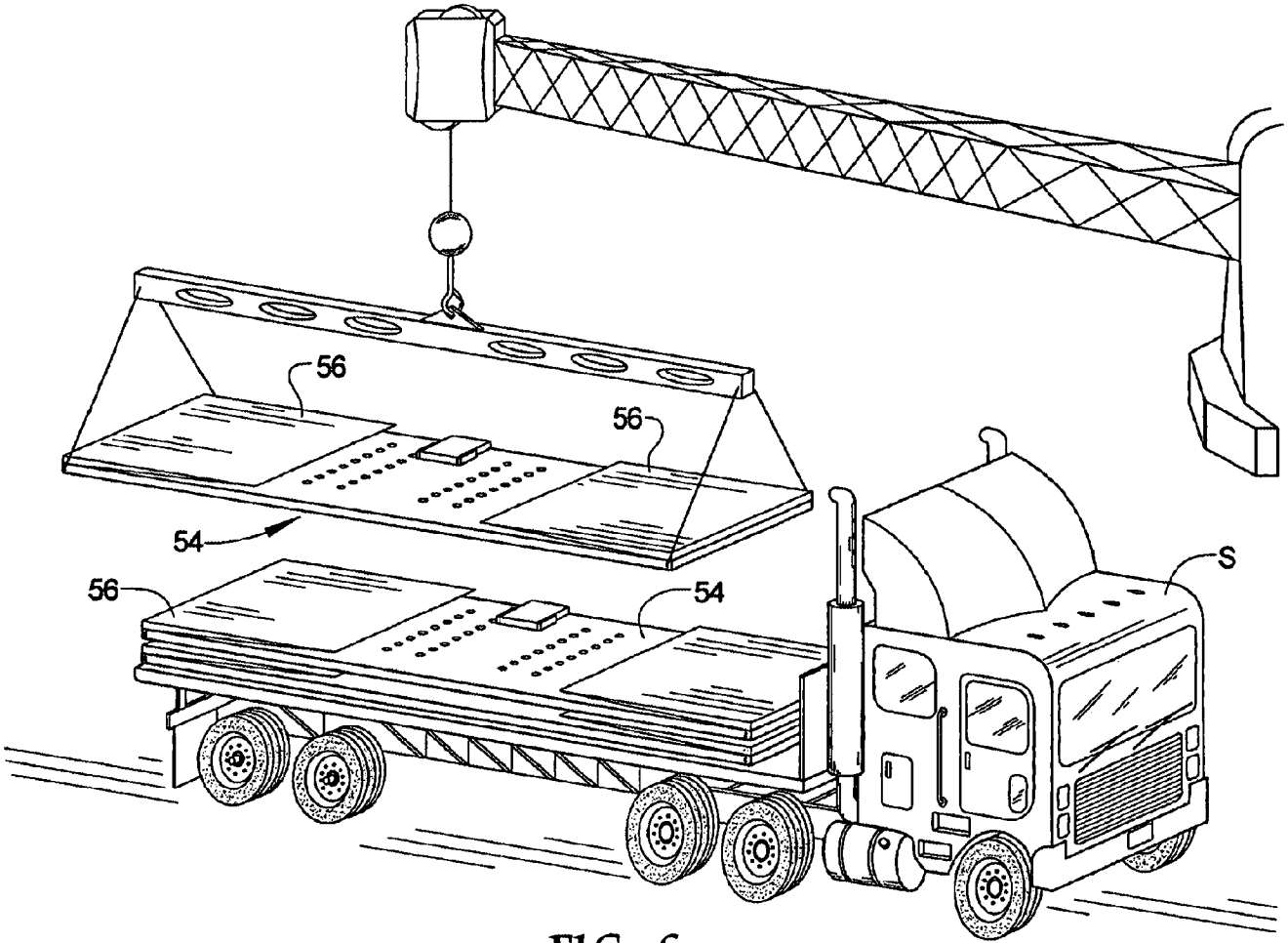
FIG. 6 is an environmental view of the retractable speed bump of the present invention held within a portable platform being loaded onto a truck.
Figure 7:
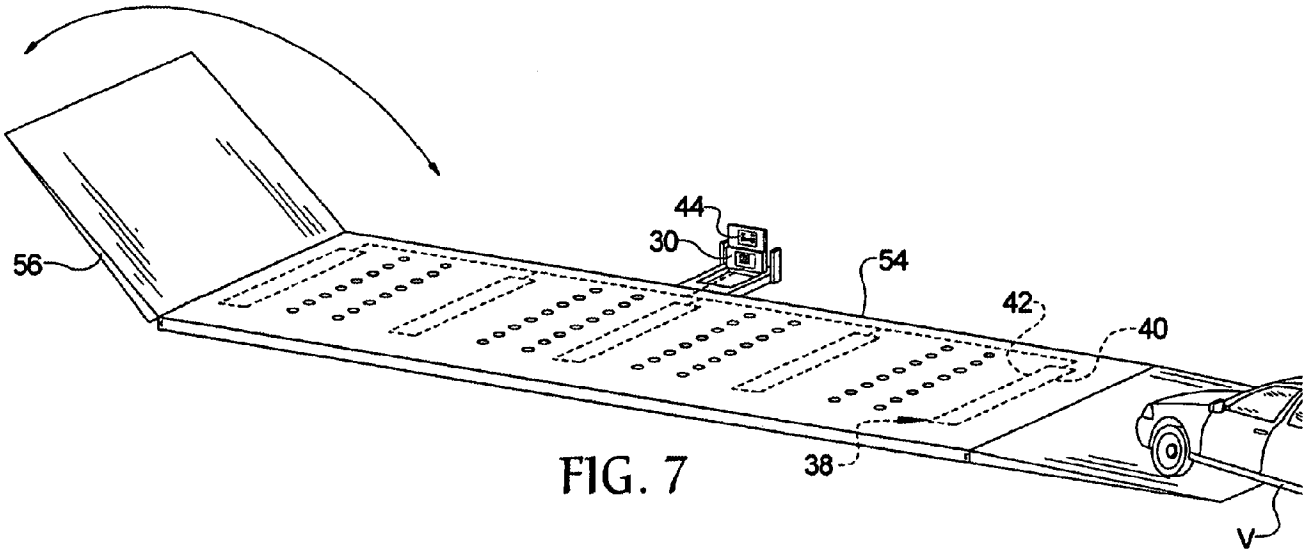
FIG. 7 is a perspective view of the retractable speed bump of FIG. 6 being encountered by a vehicle.
Figure 8:
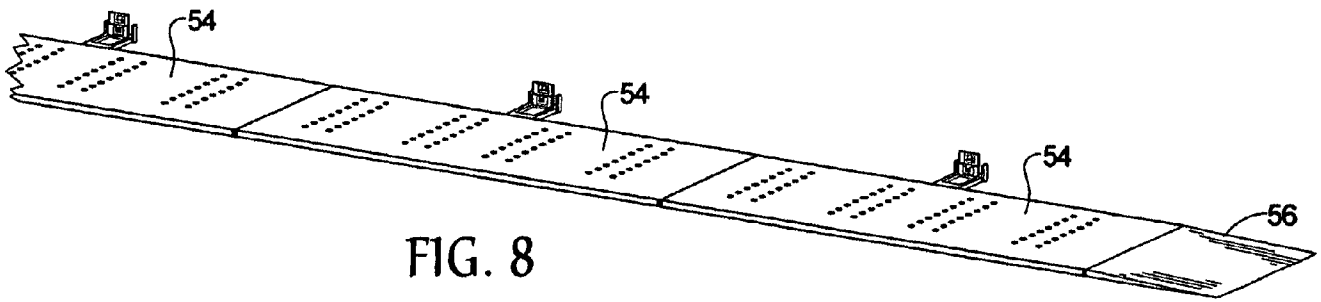
FIG. 8 is a perspective view of the retractable speed bump of FIG. 6 with several devices interconnected.

As seen in FIGS. 6–8, the housing 12 can be disposed within a ramp body 54, the ramp body 54 having on and off ramps 56 at either end. The ramp body 54 is portable and can be placed onto any roadway R for temporary use at a given site such as at a road construction site where the use of buried housings 12 is not practical due to the limited duration of critical speed control need. The on and off ramps 56 can be pivotally attached to their respective ends of the ramp body 54 so that they can be flipped onto the ramp body 54 for ease of storage and transport. The controller 44 and the pressure source 30 can be attached to a side of the ramp body 54 and can be slid away from the ramp body 54 in order to reduce the possibility of a driver accidentally hitting the controller 44 and pressure source 30. For transport, the controller 44 and pressure source 30 are slid back toward the ramp body 54 and are flipped onto the top of the ramp body 54 for ease of transport and storage. As seen in FIG. 8, several ramp bodies 52 can be connected together depending on the desired length of the speed control zone to be established by the present invention. Each ramp body 54 on the end of this ramp body string has one on and off ramp 56 attached thereto. Each ramp body 54 has its own controller 44 and pressure source 30. The ramp bodies 52 and the on and off ramps 56 are made from an appropriate material, such as metal, etc., that can handle a steady flow of vehicle traffic thereover. When speed control is desired at a particular site, one or more ramp bodies 54 are transported to the site in appropriate fashion, such as by the illustrated truck S, and placed into desired position. Once speed control at the site is no longer required, as when construction is complete, the ramp bodies 52 are removed.

While the invention has been particularly shown and described with reference to an embodiment thereof, it will be appreciated by those skilled in the art that various changes in form and detail may be made without departing from the spirit and scope of the invention.

We claim:

1. A speed control device for controlling the speed of a vehicle, the speed control device comprising:

a housing having a top with an opening, a bottom, and a hollow interior;

a plate having an upper surface and a lower surface, the plate slidably disposed within the interior of the housing;

a bump canister disposed within the interior of the housing and capable of protruding through the opening;

a spring disposed within the interior of the housing and having a first end abutting the top of the housing and a second end abutting the upper surface of the plate; and a pressure source connected to the housing and capable of placing pressure, either hydraulic or pneumatic, on the lower surface of the plate such that when the pressure source places pressure onto the plate, the plate slides upwardly toward the top of the housing causing the bump canister to protrude through the opening and when the pressure source is not placing pressure onto the plate, the plate slides downwardly toward the bottom of the housing through the biasing action of the spring on the plate, causing the bump canister to retract back into the housing.

2. The speed control device wherein the pressure source is activated by a speed sensor that detects the speed of the vehicle such that the pressure source places pressure on the plate whenever the speed sensor detects a vehicle traveling above a defined speed.

3. The speed control device as in claim 2 wherein the amount of pressure exerted by the pressure source is proportional to the amount of speed above the defined speed that the vehicle is traveling as detected by the speed sensor.

4. The speed control device as in claim 2 wherein the speed sensor is a sensor loop that is buried within the path of travel of the vehicle.

5. The speed control device as in claim 2 wherein the speed sensor is a radar gun.

6. The speed control device as in claim 1 wherein the bump canister has at least one tubular member that has an angled and sharp top end that is capable of contacting a tire of the vehicle as the vehicle passes over the bump canister that is protruding through the opening of the housing.

7. The speed control device as in claim 1 wherein the housing is buried within a roadway.

8. The speed control device as in claim 7 wherein the top of the housing is flush with the roadway.

9. The speed control device as in claim 7 wherein the top of the housing is disposed above the roadway.

10. The speed control device as in claim 9 wherein a top surface of the canister is rounded.

11. The speed control device as in claim 1 wherein the housing is disposed within a ramp member, the ramp member capable of being removably seated onto an existing roadway.

12. A speed control device for controlling the speed of a vehicle, the speed control device comprising:

a housing having a top with an opening, a bottom, and a hollow interior;

a speed sensor for sensing the speed of the vehicle;

a spring disposed within the interior of the housing and having a first end abutting the top of the housing and a second end abutting the upper surface of the plate; and a bump canister disposed within the interior of the housing, the bump canister axially extending between an extended position wherein the bump canister protrudes through the opening of the housing and a retracted position wherein the bump canister retracts back into the housing, the axial extension of the bump canister being controlled by the speed sensor such that when the speed sensor senses the vehicle is traveling above a defined speed, the bump canister is placed into the extended position, otherwise, the bump canister is placed into the retracted position through the biasing action of the spring on the bump canister.

13. The speed control device as in claim 12 wherein a pressure source is connected to the housing and capable of placing pressure, either hydraulic or pneumatic, onto the bump canister for articulating the bump canister into the extended position.

14. The speed control device as in claim 13 wherein the amount of pressure exerted by the pressure source is proportional to the amount of speed above the defined speed that the vehicle is traveling as detected by the speed sensor.

15. The speed control device as in claim 12 wherein the amount of extension of the bump canister is proportional to the amount of speed above the defined speed that the vehicle is traveling as detected by the speed sensor.

16. The speed control device as in claim 12 wherein the speed sensor is a sensor loop that is buried within the path of travel of the vehicle.

17. The speed control device as in claim 12 wherein the speed sensor is a radar gun.

18. The speed control device as in claim 12 wherein the bump canister has at least one tubular member that has an angled and sharp top end that is capable of a tire of the vehicle as the vehicle passes over the bump canister that is in the extended position.

19. The speed control device as in claim 12 wherein the housing is buried within a roadway.

20. The speed control device as in claim 19 wherein the top of the housing is flush with the roadway.

21. The speed control device as in claim 19 wherein the top of the housing is disposed above the roadway.

22. The speed control device as in claim 21 wherein a top surface of the canister is rounded.

23. The speed control device as in claim 12 wherein the housing is disposed within a ramp member the ramp member capable of being removably seated onto an existing roadway.

* * * * *